US005760547A

United States Patent [19]

Borowiec

[11] Patent Number: 5,760,547

[45] Date of Patent: Jun. 2, 1998

[54] MULTIPLE-DISCHARGE ELECTRODELESS FLUORESCENT LAMP

[75] Inventor: Joseph Christopher Borowiec, Schenectady, N.Y.

[73] Assignee: General Electric Company, Schenectady, N.Y.

[21] Appl. No.: 707,677

[22] Filed: Sep. 4, 1996

[51] Int. Cl.[6] ..... H05B 41/16

[52] U.S. Cl. ..... 315/248; 315/344; 315/57; 313/493; 313/160

[58] Field of Search ..... 315/248, 344, 315/39, 57; 313/493, 160, 161

[56] References Cited

U.S. PATENT DOCUMENTS

| | | | |
|---|---|---|---|
| 3,611,015 | 10/1971 | Kim | 315/265 |
| 4,894,590 | 1/1990 | Witting | 315/248 |
| 4,959,584 | 9/1990 | Anderson | 315/248 X |
| 5,039,903 | 8/1991 | Farrall | 313/160 |
| 5,367,226 | 11/1994 | Ukegawa et al. | 315/248 |
| 5,412,288 | 5/1995 | Borowiec et al. | 315/248 |
| 5,438,235 | 8/1995 | Sommerer et al. | 315/248 X |
| 5,446,350 | 8/1995 | El-Hamamsy et al. | 315/248 |
| 5,461,284 | 10/1995 | Roberts et al. | 315/57 |

OTHER PUBLICATIONS

"Electrodeless Fluoroescent Lamp Having Feed Through For Direct Connection to Internal EMI Shield and for Supporting an Amalgam", JP Cocoma, Serial No. 08/672, 490, filed Jun. 26, 1996.

*Primary Examiner*—Robert Pascal
*Assistant Examiner*—Haissa Philogene
*Attorney, Agent, or Firm*—Jill M. Breedlove; Douglas E. Stoner

[57] ABSTRACT

For a given lamp size and lumen power, an electrodeless fluorescent lamp is configured with a split excitation coil and a baffle structure to provide multiple discharges, resulting in a higher light output and higher luminous efficacy.

9 Claims, 4 Drawing Sheets

MULTIPLE-DISCHARGE ELECTRODELESS FLUORESCENT LAMP

FIELD OF THE INVENTION

The present invention relates generally to electrodeless fluorescent lamps and, more particularly, to an electrodeless fluorescent lamp having multiple discharges.

BACKGROUND OF THE INVENTION

In an electrodeless fluorescent lamp, such as that sold under the trademark Genura by General Electric Company, an inductively coupled discharge, primarily made up of excited mercury atoms, creates a flux of ultraviolet photons which are converted to visible light upon incidence with a phosphor coating on the inside wall of the lamp. The electromagnetic field for creating and sustaining this discharge is generated by a solenoid driven by an electronic ballast which is distinctly separate from the lamp. The electromagnetic field for a 23 Watt, 48 LPW Genura™ lamp oscillates at about 2.65 MHz and drives a discharge current of about 3 to 4 amperes (rms).

Although the luminous efficacy for such an electrodeless fluorescent lamp is satisfactory for widespread practical use, it is always desirable to increase the output and luminous efficacy even further.

SUMMARY OF THE INVENTION

An electrodeless fluorescent lamp is configured to provide a plurality n of arc discharges when subjected to an alternating magnetic field. The electrodeless fluorescent lamp includes a light-transmissive envelope containing an ionizable, gaseous fill and an excitation coil situated proximate the envelope for providing the alternating magnetic field when excited by an alternating current energy source. The excitation coil comprises n spatially separated excitation coil portions configured such that each of the n arc discharges is associated with a respective excitation coil portion. The lamp further comprises a baffle for separating each respective excitation coil portion. Advantageously, for a given lamp size and lumen power, the multiple discharges result in a higher light output and higher luminous efficacy as compared with a single discharge.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
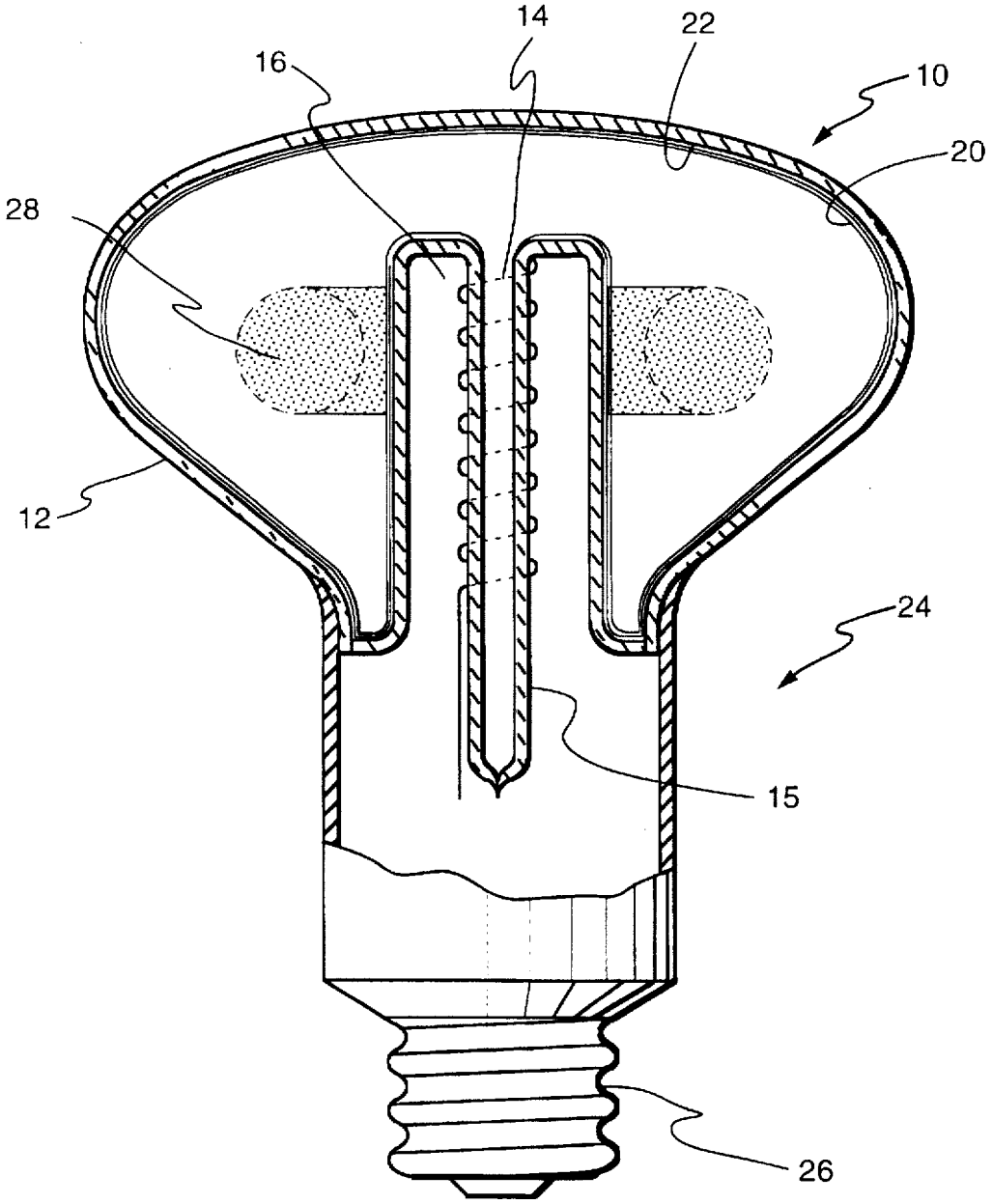
FIG. 1 (PRIOR ART)
FIG. 1 is a front view, partially in cross section, illustrating a typical electrodeless fluorescent lamp.

FIG. 1 illustrates an electrodeless fluorescent discharge lamp 10 having an envelope, or bulb, 12 containing an ionizable gaseous fill. Envelope 12 is typically made of soda lime glass. Although the present invention is illustrated with reference to an electrodeless fluorescent lamp, the principles of the present invention apply equally to other types of electrodeless lamps which emit radiation having a wavelength in a range from approximately 100 nanometers (nm) to 1000 nm.

A suitable fill for the electrodeless fluorescent lamp of FIG. 1 comprises a mixture of a rare gas (e.g., krypton and/or argon) and mercury vapor and/or cadmium vapor. An excitation coil 14 is situated within, and removable from, a re-entrant cavity 16 within envelope 12. For purposes of illustration, coil 14 is shown schematically as being wound about an exhaust tube 15 which is used for filling the lamp. However, the coil may be spaced apart from the exhaust tube and wound about a core of insulating material or may be free standing, as desired.

The interior surface of envelope 12 has a suitable phosphor coating 20. Typically, a protective coating 22, such as, for example, that sold under the trademark Alon by the Baikowski Company, is applied before the phosphor coating is applied in order to protect the phosphor.

Envelope 12 fits into one end of a base assembly 24 containing a radio frequency ballast (not shown) with a standard, e.g., Edison type, lamp base 26 at the other end. A suitable ballast is described in commonly assigned U.S. Pat. No. 5,446,350 of S.-A. El-Hamamsy et al., issued Aug. 29, 1995 and incorporated by reference herein.

In operation, current flows in coil 14 as a result of excitation by a radio frequency power supply (not shown). As a result, a radio frequency magnetic field is established within envelope 12, in turn creating an electric field which ionizes and excites the gaseous fill contained therein, resulting in an ultraviolet-producing discharge 28. Phosphor 20 absorbs the ultraviolet radiation and emits visible radiation as a consequence thereof.

Figure 2:
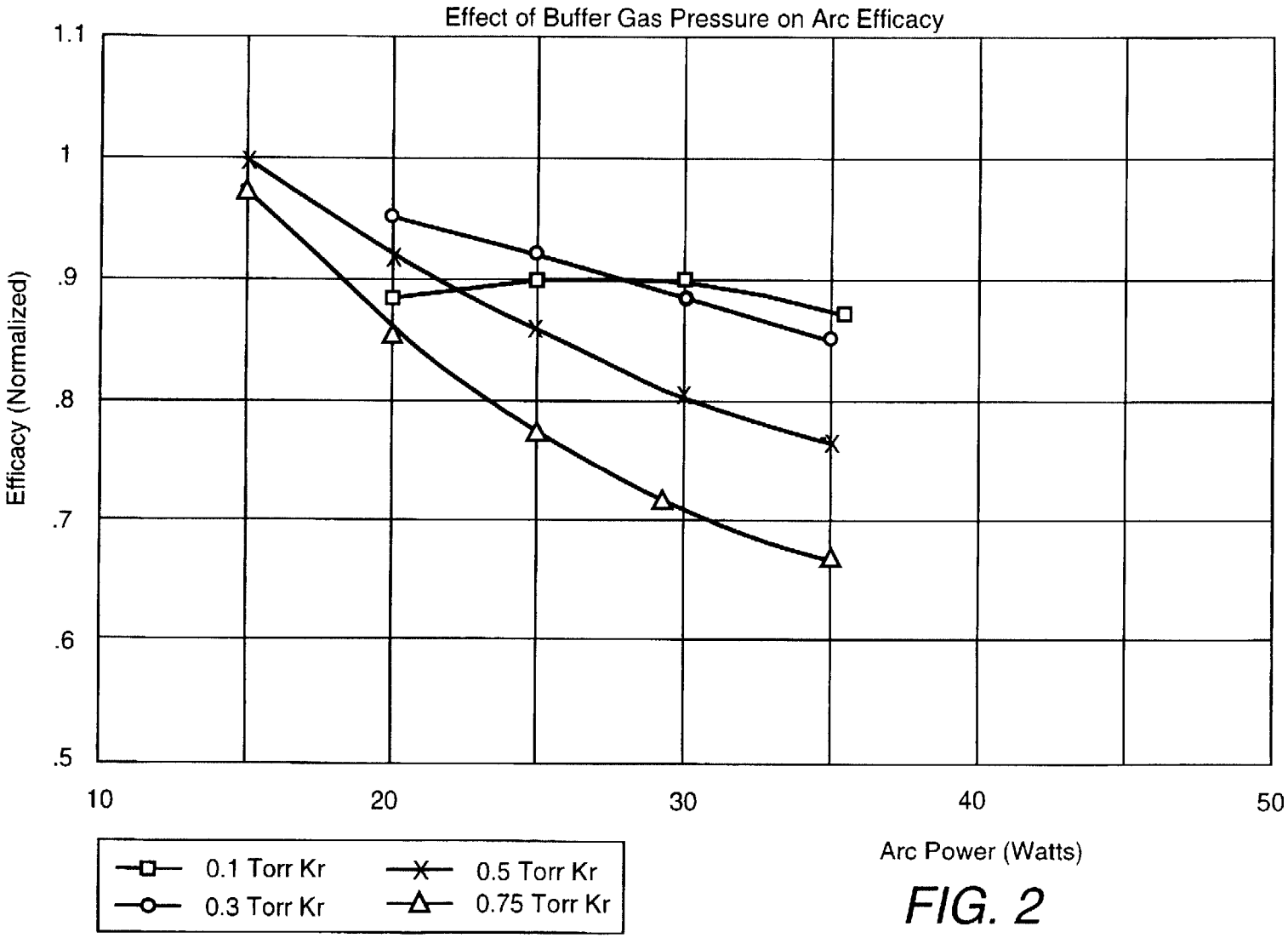
FIG. 2 graphically illustrates efficacy versus arc power as a function of buffer gas pressure.

The luminous efficacy of an electrodeless lamp such as that of FIG. 1 depends upon several variables. The arc efficacy for a given lamp geometry is a function of the current density of the discharge. As illustrated in FIG. 2, increasing power into the discharge will increase the current density, resulting in a decrease in luminous efficacy due to significant reabsorption, i.e., increasing the nonradiative transfer of energy.

In accordance with the present invention, an electrodeless lamp is configured to generate multiple lower-power discharges. For a given lamp size and total lumen power, the multiple lower-power discharges produce a higher lamp efficacy than the single discharge, thereby advantageously providing higher light output and higher luminous efficacy.

Figure 3:
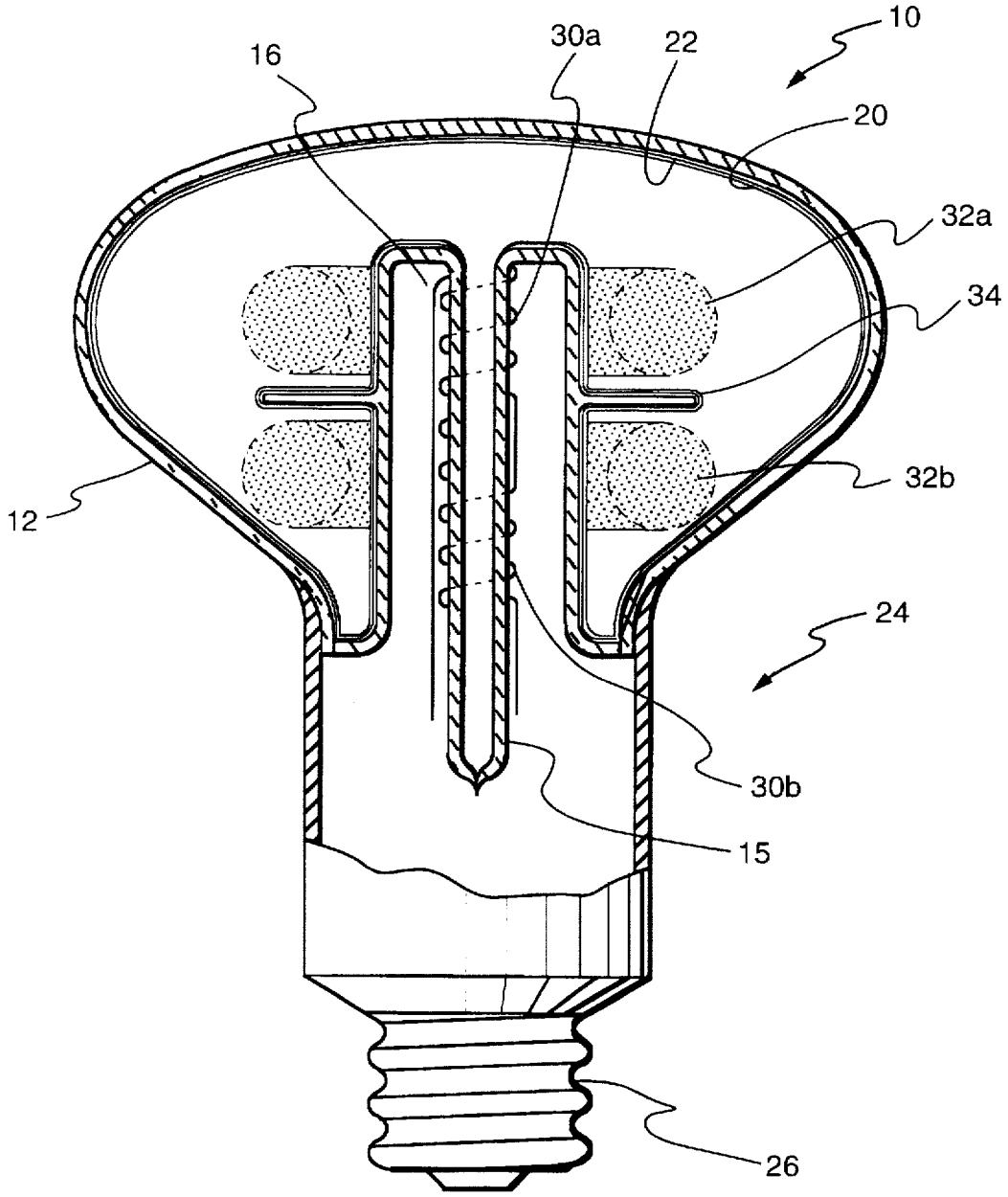
FIG. 3 is a front view, partially in cross section, illustrating an electrodeless fluorescent lamp of the present invention operating to provide multiple discharges.
Figure 4:
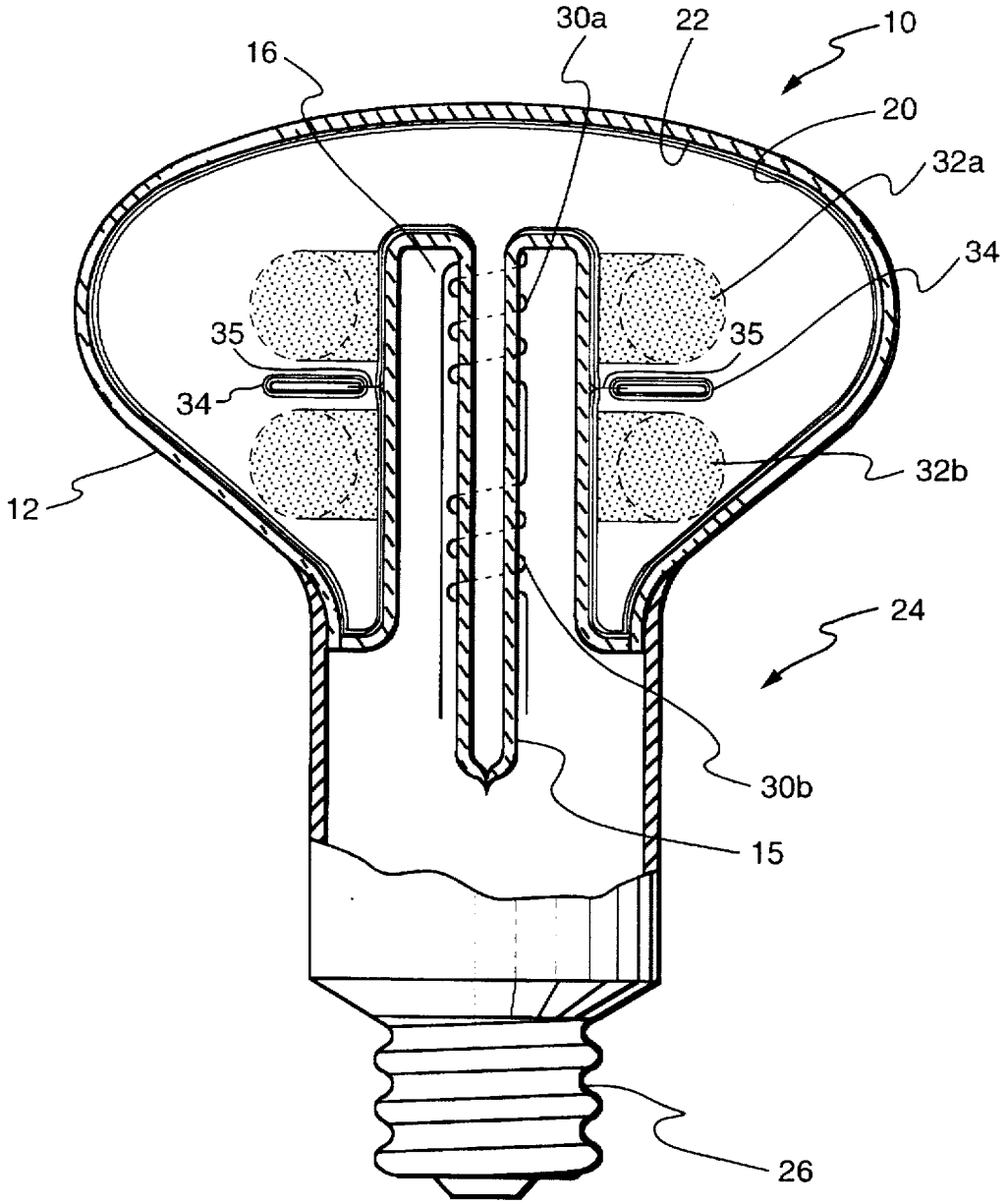
FIG. 4 is a front view, partially in cross section, illustrating an alternative embodiment of an electrodeless fluorescent lamp according to the present invention.

FIG. 3 illustrates a preferred embodiment of an electrodeless fluorescent lamp in accordance with the present invention. The excitation coil (indicated by reference numeral 30) is divided into n spatially separated excitation coil portions to provide n discharges. In the illustrated embodiment of FIG. 3, excitation coil 30 is divided into two coil portions 30*a* and 30*b*, resulting in two discharges 32*a* and 32*b*. A baffle 34 is also employed for separating the discharges. Baffle 34 is made of a non-conductive material having a low vapor pressure at the operating temperature of the lamp, such as, for example, glass or a ceramic. As illustrated in FIG. 3, the baffle may be part of the re-entrant cavity, i.e., integral therewith. Alternatively, as illustrated in FIG. 4, the baffle may be separate from and inserted about the re-entrant cavity and mechanically held in place using supports 35, e.g., wire.

EXAMPLE

A spherical lamp having an outside diameter of 76 mm, a re-entrant cavity of 22 mm diameter, and a 40 mm diameter baffle was constructed. The lamp was dosed with mercury and filled with 0.5 torr of Krypton. The drive coil (air core) consisted of two separate excitation coil portions of 4 turns each connected in series. Each coil portion was positioned approximately in the center of its respective hemisphere of the lamp. Upon application of power to the lamp, two distinctly separate discharges were produced in the lamp. The discharges were stable over the period of operation of the lamp.

As described hereinabove, each coil portion can be connected in series such that each of the n arc discharges is associated with a separate respective coil portion. Alternatively, each excitation coil portion can be independently excited from one or more radio frequency power supplies.

The n discharges generated by the electrodeless lamp of the present invention are not necessarily of equal power. Advantageously, therefore, a lamp according to the present invention may be configured to have independently selectable power output levels. For example, in a lamp having two discharges, for example, a three-way lamp may be configured by having either discharge or both discharges on.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless discharge lamp, comprising:

a light-transmissive envelope containing an ionizable, gaseous fill configured for sustaining a plurality n of arc discharges when subjected to an alternating magnetic field and for emitting radiation having a wavelength in a range from approximately 100 nm to approximately 1000 nm as a result thereof;

an excitation coil situated proximate the envelope for providing the alternating magnetic field when excited by an alternating current energy source, the excitation coil comprising n spatially separated excitation coil portions such that each of the n arc discharges is associated with a respective excitation coil portion.

2. The lamp of claim 1 wherein the n spatially separated excitation coil portions are connected in series, the lamp further comprising a baffle for separating each respective coil portion.

3. The lamp of claim 1 wherein each excitation coil portion is independently excited, the lamp further comprising a baffle for separating each respective coil portion.

4. The lamp of claim 3 comprising a plurality of independently selectable output power levels.

5. The lamp of claim 1, comprising an electrodeless fluorescent lamp, each arc discharge emitting ultraviolet radiation when subjected to the alternating frequency magnetic field, the envelope having an interior phosphor coating for emitting visible radiation when excited by the ultraviolet radiation, the envelope further having a re-entrant cavity formed therein, the excitation coil being contained within the re-entrant cavity.

6. The lamp of claim 5, further comprising a baffle for separating each respective coil portion, the baffle being integral with the re-entrant cavity.

7. The lamp of claim 5 wherein the n spatially separated excitation coil portions are connected in series, the lamp further comprising a baffle for separating each respective coil portion.

8. The lamp of claim 5 wherein each excitation coil portion is independently excited, the lamp further comprising a baffle for separating each respective coil portion.

9. The lamp of claim 8 comprising a plurality of independently selectable output power levels.

* * * * *